US012241146B1

(12) United States Patent
Kim et al.

(10) Patent No.: US 12,241,146 B1
(45) Date of Patent: Mar. 4, 2025

(54) HIGH ELONGATION DIE CASTING ALLOY COMPOSITION FOR NON-HEAT TREATMENT

(71) Applicants: DnK Mobility CO.,LTD., Ulsan (KR); KONEC CO.,LTD., Seosan-si (KR); Dongnam CO.,LTD., Changwon-si (KR)

(72) Inventors: Eok Soo Kim, Ulsan (KR); Kwang Pyo Lee, Seongnam-si (KR); Young Chul Kang, Busan (KR)

(73) Assignees: DnK Mobility CO., LTD., Ulsan (KR); KONEC CO., LTD., Seosan-si (KR); Dongnam CO., LTD., Changwon-si (KR)

( * ) Notice: Subject to any disclaimer, the term of this patent is extended or adjusted under 35 U.S.C. 154(b) by 0 days.

(21) Appl. No.: 18/739,914

(22) Filed: Jun. 11, 2024

(30) Foreign Application Priority Data

Apr. 11, 2023 (KR) ..... 10-2023-0047500

(51) Int. Cl.
*C22C 21/02* (2006.01)

(52) U.S. Cl.
CPC ..... *C22C 21/02* (2013.01)

(58) Field of Classification Search
CPC ..... C22C 21/02; C22F 1/043
See application file for complete search history.

(56) References Cited

FOREIGN PATENT DOCUMENTS

| | | | |
|---|---|---|---|
| JP | 2005-281829 | A | 10/2005 |
| KR | 10-2011-0065122 | A | 6/2011 |
| KR | 10-2461964 | B1 | 11/2022 |

OTHER PUBLICATIONS

Elhadari, H. A., et al. "Tensile and fatigue properties of a cast aluminum alloy with Ti, Zr and V additions." Materials Science and Engineering: A 528.28 (2011): 8128-8138.*

Korean Office Action issued on May 10, 2023 in corresponding Korean Application No. 10-2023-0047500 (4 pages in Korean and 3 pages in English).

* cited by examiner

*Primary Examiner* — Jessee R Roe
(74) *Attorney, Agent, or Firm* — NSIP Law

(57) ABSTRACT

The alloy composition for non-heat treatment includes 6.0 to 8.5% by weight of silicon (Si), 0.001 to 0.3% by weight of copper (Cu), 0.05 to 0.35% by weight of magnesium (Mg), 0.15 to 0.30% by weight of iron (Fe), 0.3 to 0.6% by weight of manganese (Mn), 0.001 to 0.3% by weight of zinc (Zn), 0.08 to 0.15% by weight of titanium (Ti), 0.01 to 0.03% by weight of strontium (Sr), and the balance aluminum (Al) wherein the silicon (Si) and magnesium (Mg) contents satisfy Relationship 1: $15.0<Si/Mg<60.0$ (1) where Si/Mg represents the ratio of the silicon content to the magnesium content and is 30 or more when Si is 7.5 or more.

6 Claims, 9 Drawing Sheets

| Si content | Measurement 1 | Measurement 2 | Flowability (cm) |
|---|---|---|---|
| 6.5% |  |  | 16.09~ 16.09 |

| Si content | Measurement 1 | Measurement 2 | Flowability (cm) |
|---|---|---|---|
| 7.5% |  |  | 16.54~ 17.42 |

| Si content | Measurement 1 | Measurement 2 | Flowability (cm) |
|---|---|---|---|
| 8.5% |  |  | 17.42~ 17.87 |

| Si content | Measurement 1 | Measurement 2 | Flowability (cm) |
|---|---|---|---|
| 9.5% |  |  | 17.42~ 17.87 |

(a)

(b)

(a)

(b)

HIGH ELONGATION DIE CASTING ALLOY COMPOSITION FOR NON-HEAT TREATMENT

CROSS-REFERENCE TO RELATED APPLICATION(S)

This application claims the benefit under 35 USC 119 (a) of Korean Patent Application No. 10-2023-0047500, filed with the Korean Intellectual Property Office on Apr. 11, 2023, the disclosure of which is incorporated herein by reference in its entirety.

BACKGROUND OF THE INVENTION

1. Field of the Invention

The present invention relates to a high elongation die casting alloy composition for non-heat treatment, and more specifically to a die casting alloy composition for non-heat treatment in which the amounts of silicon and magnesium are controlled to achieve high elongation.

2. Description of the Related Art

Casting processes are roughly divided into gravity die casting, low pressure die casting under a pressure of ≤1 bar, and high pressure die casting under a pressure of ≥30 MPa depending on the casting pressure. Among these, high pressure die casting is widely used for the mass production of automobile parts due to its high productivity.

The most typical high vacuum commercial die casting alloys for automobile body parts that have been developed and are currently being produced on an industrial scale are Silafont-36, Castasil-37, and Magsimal-59, all of which are available from Rheinfelden (Germany). Silafont-36 is a commercial alloy for heat treatment and Castasil-37 and Magsimal-59 are commercial alloys for non-heat treatment. Other improved alloys have been developed based on alloy compositions available from Rheinfelden and some of them are currently in use.

The commercial alloy for non-heat treatment Castasil-37 contains a similar amount of Si to Silafont-36 to ensure castability and a very small amount of Mg to obtain high elongation when cast. Castasil-37 further contains Mo and Zr to prevent a decrease in strength. However, the expensive elements Mo and Zr cause a rise in cost. Magsimal-59 is an Al—Mg-based alloy and its Si content affecting flowability is controlled to the range of 1.8 to 2.6%. The controlled Si content leads to poor castability, causing difficulty in producing the alloy. Magximal-59 contains 5.0 to 6.0% of Mg. The high Mg content leads to oxidation of the molten metal and incurs a considerable cost in holding the molten metal. The mechanical properties of the product depend relatively greatly on the thickness of the product, which is also becoming a problem that needs to be solved.

PRIOR ART DOCUMENTS

Patent Documents (Patent Document 001) Korean Patent No. 10-2462227

SUMMARY OF THE INVENTION

The present invention has been made in an effort to solve the above-described problems, and it is one object of the present invention to provide a high elongation die casting alloy composition for non-heat treatment that ensures flowability of the molten metal with high castability suitable for high vacuum die casting and exhibits improved stickiness to a mold and excellent mechanical properties, including high elongation.

It is a further object of the present invention to provide a high elongation die casting alloy for non-heat treatment that is made of the alloy composition.

One aspect of the present invention provides a high elongation die casting alloy composition for non-heat treatment including 6.0 to 8.5% by weight of silicon (Si), 0.001 to 0.3% by weight of copper (Cu), 0.05 to 0.35% by weight of magnesium (Mg), 0.15 to 0.30% by weight of iron (Fe), 0.3 to 0.6% by weight of manganese (Mn), 0.001 to 0.3% by weight of zinc (Zn), 0.08 to 0.15% by weight of titanium (Ti), 0.01 to 0.03% by weight of strontium (Sr), and the balance aluminum (Al) wherein the silicon (Si) and magnesium (Mg) contents satisfy Relationship 1:

$$15.0<Si/Mg<60.0 \quad (1)$$

where Si/Mg represents the ratio of the silicon content to the magnesium content and is 30 or more when Si is 7.5 or more.

A further aspect of the present invention provides a high elongation die casting alloy for non-heat treatment that is made of the alloy composition.

The alloy composition of the present invention is suitable for aluminum non-heat treatable alloy for high vacuum die casting and imparts high toughness corresponding to an elongation of at least 8% after die casting and before heat treatment. The alloy composition of the present invention can be used to manufacture one-piece aluminum parts that can replace existing many steel (iron)-based welded and joined automobile body parts. As a result, the use of the alloy composition according to the present invention contributes to a 30-50% weight reduction and can achieve a 30% cost saving in the automobile body assembly process. Furthermore, the use of the alloy composition according to the present invention can avoid thermal deformation, which is the most serious quality problem during heat treatment. Moreover, the use of the alloy composition according to the present invention can eliminate the need for heat treatment, which can reduce high energy costs for heat treatment and process input costs, innovatively contributing to a reduction in manufacturing cost and leading to carbon neutrality.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE INVENTION

Figure 1A:
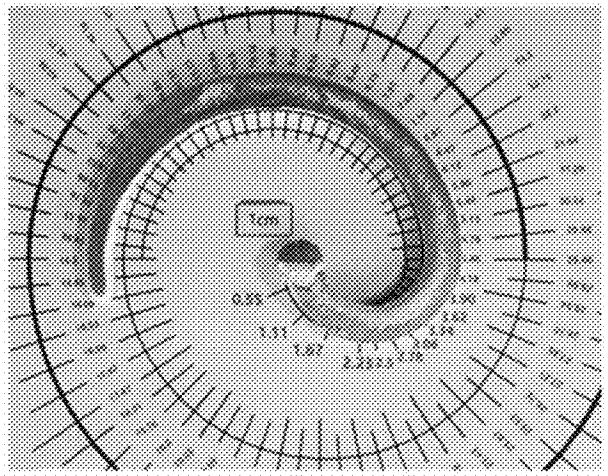
FIGS. 1A to 1D show the flowabilities of alloy compositions containing different amounts of Si as an alloy element.
Figure 1A:
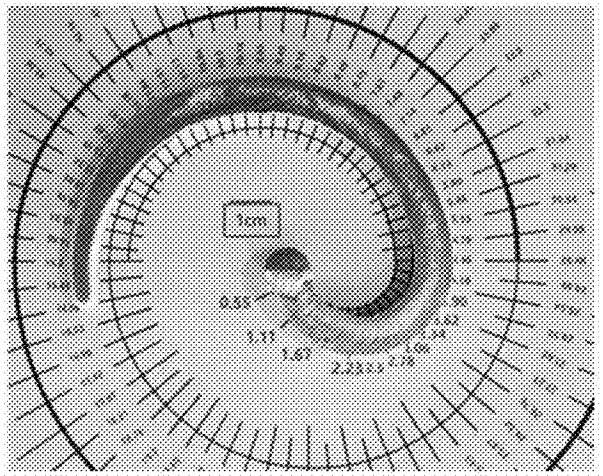
Figure 1B:
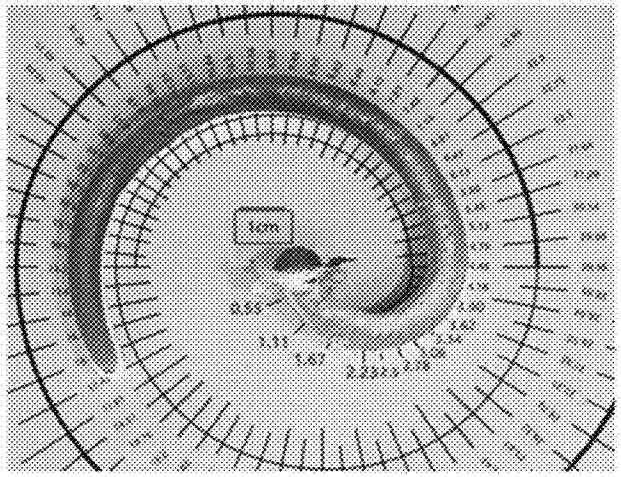
Figure 1B:
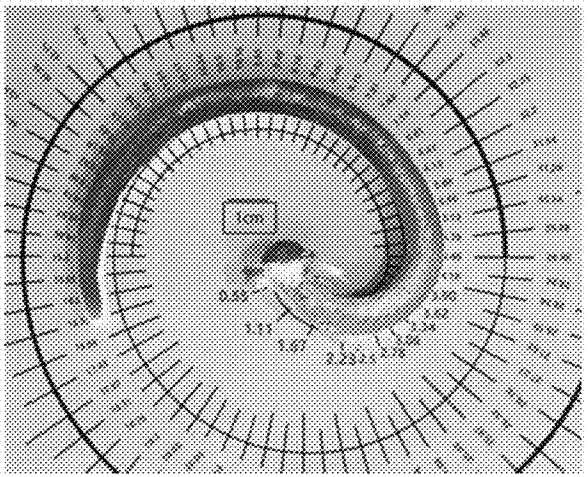
Figure 1C:
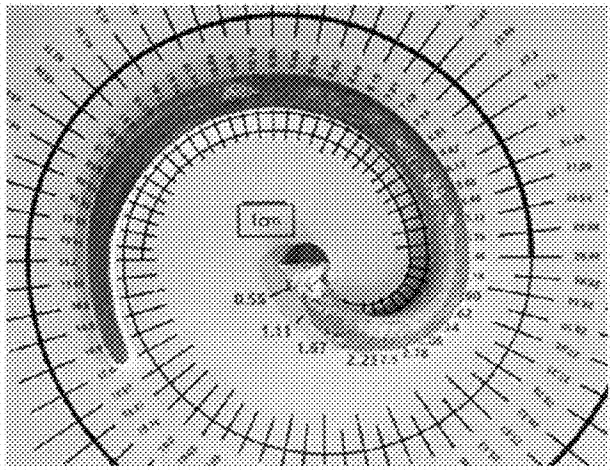
Figure 1C:
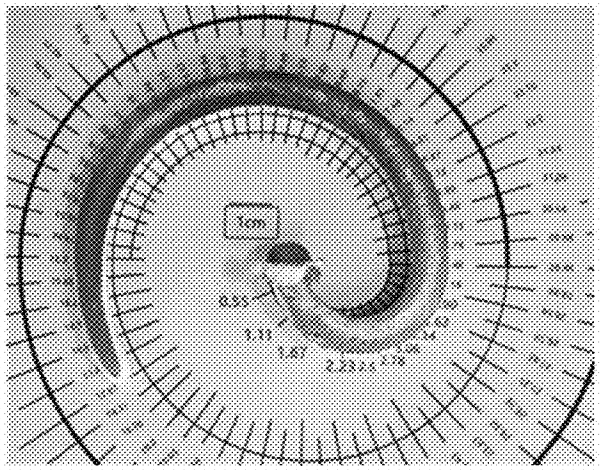
Figure 1D:
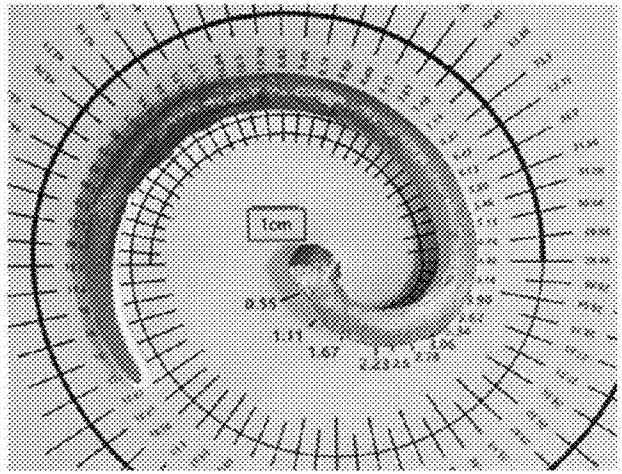
Figure 1D:
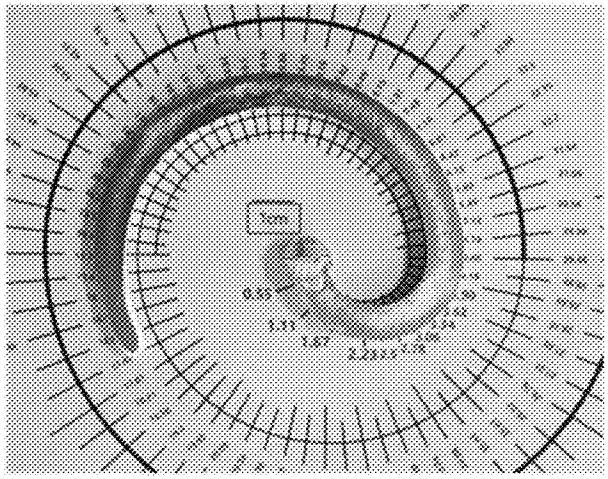

The present invention will now be described in more detail.

One aspect of the present invention provides a high elongation die casting alloy composition for non-heat treatment including 6.0 to 8.5% by weight of silicon (Si), 0.001 to 0.3% by weight of copper (Cu), 0.05 to 0.35% by weight of magnesium (Mg), 0.15 to 0.30% by weight of iron (Fe), 0.3 to 0.6% by weight of manganese (Mn), 0.001 to 0.3% by weight of zinc (Zn), 0.08 to 0.15% by weight of titanium (Ti), 0.01 to 0.03% by weight of strontium (Sr), and the balance aluminum (Al) wherein the silicon (Si) and magnesium (Mg) contents satisfy Relationship 1:

$$15.0<Si/Mg<60.0 \quad (1)$$

where Si/Mg represents the ratio of the silicon content to the magnesium content and is 30 or more when the Si content is 7.5% by weight or more.

The aluminum composition of the present invention uses controlled amounts of Si and Mg, which are key elements that affect elongation and strength, to meet requirements in terms of mechanical properties such as tensile strength, yield strength, and elongation after die casting and before heat treatment. The aluminum composition of the present invention can be applied to automobile body parts without the need for heat treatment due to its significantly improved elongation compared to existing aluminum alloy compositions.

The aluminum composition of the present invention uses a reduced amount of Fe to attain high elongation and a controlled amount of Mn to prevent the die-soldering of Fe. Changes in mechanical properties depending on the Si content having the greatest influence on castability and the Mg content having the greatest influence on elongation were investigated to find optimum amounts of Si and Mg in the composition.

The functions and contents of the alloy elements as basic components of the composition according to the present invention are as follows.

(1) Silicon (Si)

Silicon (Si) is added to minimize a reduction in elongation, improve strength, and reduce dendrite arm spacing (DAS). If Si is added in an amount of less than 6.0% by weight, strength and castability deteriorate. Meanwhile, if Si is added in an amount of more than 8.5% by weight, strength increases but elongation decreases. Thus, the silicon content is preferably adjusted to 6.0 to 8.5% by weight, more preferably 6.5 to 8.5% by weight.

(2) Copper (Cu)

Copper (Cu) is used to improve the strength of alloy due to its hardening effect. If copper is added in an amount smaller than 0.001% by weight, CuAl2 as a solid solution strengthening intermetallic compound is not formed well, failing to improve strength. Meanwhile, if copper is added in an amount exceeding 0.30% by weight, low elongation and poor corrosion resistance are caused. Thus, the copper content is preferably adjusted to 0.001 to 0.30% by weight, more preferably 0.001 to 0.1% by weight, even more preferably 0.001 to 0.05% by weight.

(3) Magnesium (Mg)

Magnesium (Mg) is added for rapid growth of a dense surface oxide layer (MgO) that acts to prevent internal corrosion and improve strength. If magnesium is added in an amount of less than 0.05% by weight, strength may decrease. Meanwhile, if magnesium is added in an amount exceeding 0.35% by weight, large amounts of oxides are formed in the molten metal, which affects the quality control and casting quality of the molten metal and particularly causes a significant decrease in elongation. Thus, the magnesium content is preferably adjusted to 0.05 to 0.35% by weight, more preferably 0.10 to 0.35% by weight, even more preferably 0.15 to 0.35% by weight. Within this range, high strength and elongation can be obtained.

(4) Iron (Fe)

Iron (Fe) is added to improve strength while preventing the alloy melt from sticking to the inner wall of a mold. If iron is added is in an amount of less than 0.15% by weight, there is a difficulty in preventing sticking. Meanwhile, if iron is added is in an amount of more than 0.30% by weight, brittle compounds are formed, causing a decrease in elongation. Thus, the iron content is preferably adjusted to 0.15 to 0.30 weight %, more preferably 0.15 to 0.20 weight %, most preferably 0.15 weight %.

(5) Manganese (Mn)

Manganese (Mn) forms a fine dispersoid in a microstructure during solidification without separate heat treatment, affecting the increase in strength. When the Fe content is reduced to increase elongation, manganese is used as an alternative element to prevent die-soldering. If manganese is added in an amount of less than 0.3% by weight, its role to prevent die-soldering is difficult to expect. Meanwhile, if manganese is added in an amount exceeding 0.6% by weight, it deteriorates workability along with magnesium due to its stickiness. Thus, the manganese content is adjusted to preferably 0.3 to 0.6% by weight, more preferably 0.4 to 0.6% by weight, even more preferably 0.45 to 0.55% by weight.

(6) Zinc (Zn)

Zinc (Zn) is added to maximize the improvement of thermal conductivity and strength. If zinc is added in an amount of less than 0.001% by weight, mechanical properties, including strength and castability, may deteriorate. Meanwhile, if zinc is added in an amount exceeding 0.3% by weight, thermal conductivity and corrosion resistance may deteriorate. Thus, the zinc content is preferably adjusted to 0.001 to 0.3% by weight, more preferably 0.005 to 0.1% by weight, even more preferably 0.005 to 0.05% by weight.

(7) Titanium (Ti)

Titanium (Ti) is added for grain refinement to improve moldability and strength If titanium is added in an amount of less than 0.08% by weight, the grain size of the metal structure may become coarse, resulting in poor strength. Meanwhile, if titanium is added in an amount exceeding 0.15% by weight, brittleness may increase. Thus, the titanium content is preferably adjusted to 0.08 to 0.15% by weight, more preferably 0.08 to 0.10% by weight.

(8) Strontium (Sr)

Strontium (Sr) reduces the formation of pores caused by air inflow during die casting to improve the strength of the alloy. If strontium is added in an amount of less than 0.01% by weight, the Si phase cannot be made spherical in shape, deteriorating mechanical properties such as strength. If strontium is added in an amount exceeding 0.03% by weight, brittleness may increase, resulting in poor strength. Thus, the strontium content is preferably adjusted to 0.01 to 0.03% by weight, more preferably 0.01 to 0.025% by weight.

For the purpose of increasing elongation without losing mechanical properties, molybdenum (Mo) or zirconium (Zr) may be further added in an amount of more than 0% to 0.3% by weight, preferably 0.05 to 0.3% by weight, more preferably 0.05 to 0.25% by weight.

Among these alloy elements, the Si and Mg contents have the most significant effect on strength and elongation. The amount of Si (6.0 to 8.5% by weight) in the alloy composition of the present invention is larger than that of Mg (0.05 to 0.35% by weight). In view of the foregoing, high elongation requires appropriate control over the ratio of the Si content to the Mg content in the composition. Both an increase in the Si content in a state in which the Mg content is fixed or an increase in the Mg content in a state in which the Si content is fixed lead to a significant decrease in elongation. Therefore, an appropriate Si/Mg or Si+Mg value is important to obtain an elongation of 8% or more. The Si and Mg contents satisfy Relationship 1 or 2:

$$15.0<Si/Mg<60.0 \quad (1)$$

where Si/Mg represents the ratio of the silicon content to the magnesium content and is 30 or more when Si is 7.5 or more;

$$6.0<Si+Mg<9.0 \quad (2)$$

where Si+Mg represents the sum of the amounts of Si and Mg and Mg is 0.05 to 0.25 when Si is 7.5 or more.

Si/Mg representing the ratio of the Si content to the Mg content is 15.0 to 60.0, preferably 18.0 to 60.0, more preferably 18.0 to 56.0. When the Si content is 7.5% by weight or more, high elongation can be obtained only when the Mg content is 0.25% by weight or less, preferably 0.2% by weight or less. That is, Si/Mg is 30 or more, preferably 37 or more, more preferably 40 or more.

Si+Mg representing the sum of the amounts of Si and Mg is 6.0 to 9.0% by weight, preferably 6.5 to 9.0% by weight, more preferably 6.6 to 8.6% by weight. When the Si content is 7.5% by weight or more, high elongation can be obtained only when the Mg content is 0.05 to 0.25% by weight, preferably 0.1 to 0.2% by weight, more preferably 0.15 to 0.2% by weight.

A further aspect of the present invention provides a high elongation die casting alloy for non-heat treatment that is made of the alloy composition.

The alloy of the present invention meets requirements in terms of mechanical properties such as tensile strength, yield strength, flowability, and elongation even under non-heat treatment conditions after die casting. The elongation of the alloy is significantly improved to 8% or more even when the material is not heat-treated. Due to this advantage, the alloy of the present invention can be applied to automobile body parts. The elongation of the alloy is preferably 8 to 13%, more preferably 8 to 12%.

The alloy of the present invention has a yield strength of at least 105 MPa, preferably 105 to 140 MPa, a tensile strength of at least 240 MPa, preferably 240 to 260 MPa, and a flowability of 16 to 18 cm, preferably 16.0 to 17.5 cm.

The present invention will be more specifically explained with reference to the following example embodiments. The present invention may, however, be embodied in many different forms and should not be construed as limited to the example embodiments set forth herein. Rather, the disclosed embodiments are provided so that this disclosure will be thorough and complete, and will fully convey the scope of the invention to those skilled in the art.

EXAMPLES

Example 1—Preparation of Aluminum Alloy Compositions and Fabrication of Specimens Alloys having the aluminum high vacuum die casting alloy compositions shown in Table 1 were manufactured by a conventional method for manufacturing alloys. In Table 1, the amounts of the components of the compositions are given in % by weight.

TABLE 1

| Specimen | Si (wt %) | Fe (wt %) | Cu (wt %) | Mn (wt %) | Mg (wt %) | Zn (wt %) | Ti (wt %) | Sr (wt %) | Al (wt %) |
|---|---|---|---|---|---|---|---|---|---|
| Example 1 | 6.85 | 0.15 | 0.01 | 0.50 | 0.15 | 0.01 | 0.08 | 0.02 | Balance |
| Example 2 | 7.59 | 0.15 | 0.01 | 0.50 | 0.15 | 0.01 | 0.08 | 0.02 | Balance |
| Example 3 | 8.39 | 0.15 | 0.01 | 0.50 | 0.15 | 0.01 | 0.08 | 0.02 | Balance |
| Example 4 | 6.69 | 0.15 | 0.005 | 0.52 | 0.35 | 0.01 | 0.08 | 0.015 | Balance |
| Example 5 | 6.50 | 0.15 | 0.01 | 0.47 | 0.15 | 0.03 | 0.08 | 0.021 | Balance |
| Example 6 | 6.50 | 0.15 | 0.01 | 0.48 | 0.26 | 0.03 | 0.08 | 0.019 | Balance |
| Example 7 | 6.50 | 0.15 | 0.01 | 0.48 | 0.35 | 0.03 | 0.08 | 0.019 | Balance |
| Example 8 | 7.50 | 0.15 | 0.005 | 0.47 | 0.18 | 0.01 | 0.08 | 0.024 | Balance |
| Comparative Example 1 | 7.78 | 0.15 | 0.005 | 0.47 | 0.35 | 0.01 | 0.08 | 0.021 | Balance |
| Comparative Example 2 | 8.39 | 0.15 | 0.006 | 0.73 | 0.35 | 0.03 | 0.08 | 0.040 | Balance |
| Comparative Example 3 | 7.50 | 0.15 | 0.005 | 0.46 | 0.29 | 0.01 | 0.08 | 0.021 | Balance |
| Comparative Example 4 | 7.50 | 0.15 | 0.006 | 0.47 | 0.37 | 0.01 | 0.08 | 0.021 | Balance |
| Comparative Examples 5-7 | 10.5 | 0.15 | 0.02 | 0.65 | 0.45 | 0.05 | 0.1 | — | Balance |

Each of the alloy compositions of Examples 1-8 and Comparative Examples 1~4 was melted at 720° C., followed by degassing and inclusion removal to clean the molten metal to a density index (DI) of ≤1.0%. Casting for high vacuum die casting sampling was performed using a mold designed and manufactured to ensure sealability under high vacuum. After the mold was preheated to 200° C., a specimen was fabricated under appropriate casting conditions.

The composition of Comparative Example 5 is the composition of Silafont-36, a commercial high vacuum die casting alloy for heat treatment. The alloy composition was melted at 720° C. under the same conditions as in Examples 1-8 and then injected into the mold preheated to 200° C. to fabricate the same specimen. The compositions of Comparative Examples 6 and 7 were subjected to high vacuum die casting and additional heat treatment (T5 treatment and T6 treatment, respectively). The heat treatment conditions of the composition of Comparative Example 6 were 200° C. and 102 min. For the composition of Comparative Example 7, solution treatment was performed at 490° C. and aging treatment was performed at 170° C.

Example 2—Flowability Measurement

A spiral type heat-resistant steel mold was entirely preheated to 200° C. and a molten metal with a superheat of 50° C. was injected into the mold. The total distance traveled by the flowable metal through a passage before solidification was measured to quantitatively evaluate flowability.

Example 3—Strength and Elongation Measurement

The tensile strengths, yield strengths, and elongations of 15 types of tensile test pieces were measured using a universal testing machine (Instron 5985).

<Results and Discussion>

Table 2 shows the mechanical properties of the compositions of Examples 1-8 and Comparative Examples 1-7.

TABLE 2

| Specimen | Tensile strength (MPa) | Yield strength (MPa) | Flowability (cm) | Elongation (%) |
|---|---|---|---|---|
| Example 1 | 246.58 | 106.56 | 16.32 | 11.3 |
| Example 2 | 252.83 | 108.84 | 17.42 | 9.9 |
| Example 3 | 254.19 | 116.99 | 17.43 | 8.05 |
| Example 4 | 255.07 | 138.46 | 16.22 | 8.31 |
| Example 5 | 244.89 | 105.32 | 16.09 | 11.59 |
| Example 6 | 251.30 | 116.54 | 16.09 | 10.35 |
| Example 7 | 259.79 | 126.14 | 16.09 | 8.64 |
| Example 8 | 259.48 | 135.79 | 17.39 | 8.56 |
| Comparative Example 1 | 267.51 | 156.30 | 17.42 | 6.24 |
| Comparative Example 2 | 261.94 | 146.46 | 17.42 | 5.13 |
| Comparative Example 3 | 259.10 | 145.30 | 16.85 | 5.75 |
| Comparative Example 4 | 267.51 | 156.30 | 16.93 | 6.24 |
| Comparative Example 5 | 280.1 | 142.6 | 17.40 | 3.8 |
| Comparative Example 6 | 287.9 | 202.8 | 17.27 | 3.0 |
| Comparative Example 7 | 253.3 | 198.2 | 16.96 | 7.1 |

Result 1—Flowability

FIGS. 1A to 1D show the flowabilities of compositions including different amounts of Si. Referring to FIGS. 1A to 1D, the flowability was relatively good when the Si content was ≥6.5%. The flow length was 16.09 cm when the Si content was 6.5%, increased slightly to 16.54-17.42 cm when the Si content was 7.5%, and rather increased to 17.42-17.87 cm when the Si content was ≥8.5%. However, when the Si content was 9.5%, no further increase in flow length was observed. These results concluded that there was no significant improvement in flowability when the Si content was ≥8.5%.

Result 2—Strength and Elongation

FIGS. 2 to 5 show the measured mechanical properties (including elongations, tensile strengths, and yield strengths) of the 3-5 mm thick specimens after high vacuum die casting and before heat treatment.

Figure 2:
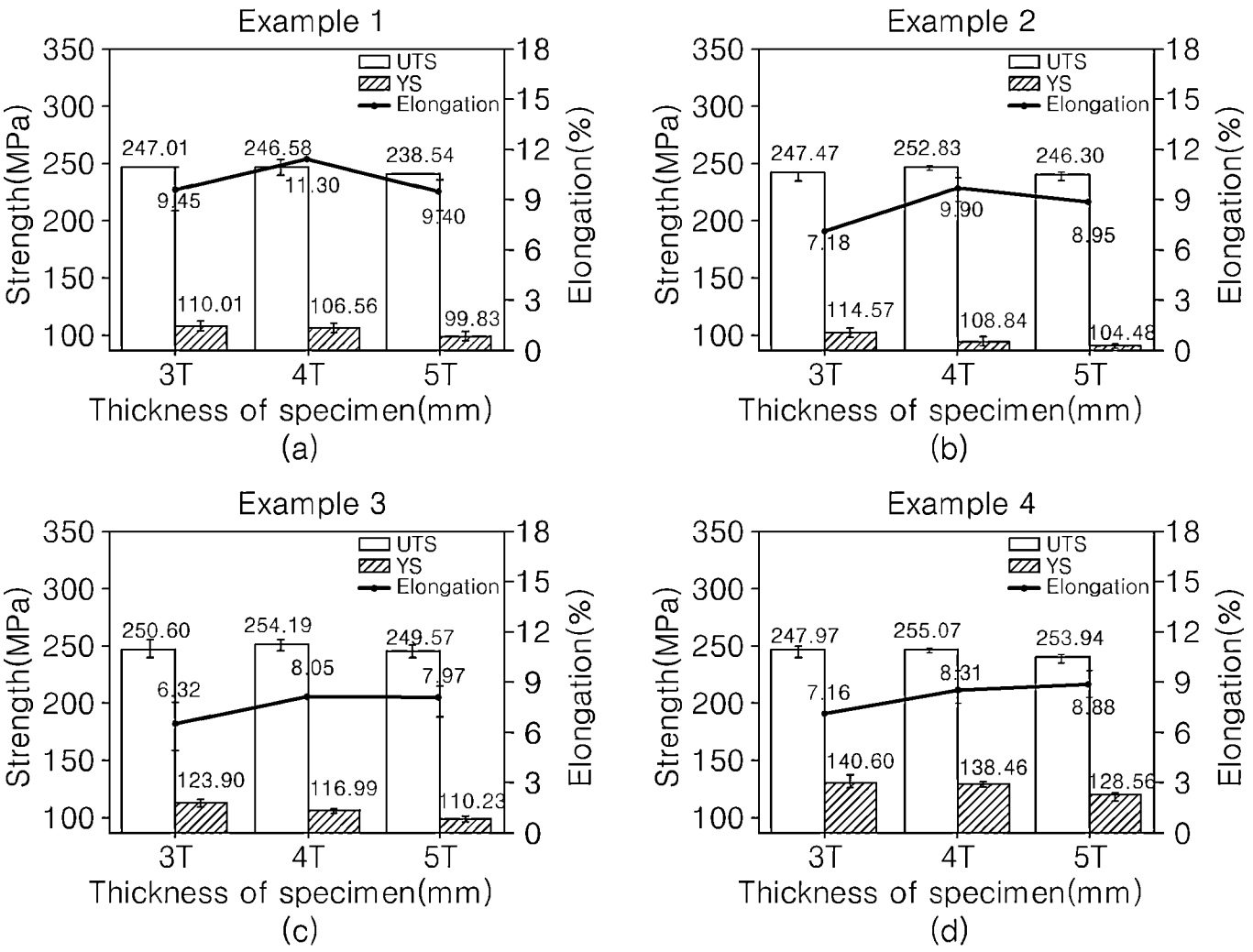
FIG. 2 shows the mechanical properties of alloy compositions prepared in Examples 1 to 4.

FIG. 2 shows the mechanical properties of the specimens of Examples 1-4. Referring to FIG. 2, the elongations of the 4 mm thick standard specimens of Examples 1-4 were 11.30%, 9.9%, 8.05%, and 8.31%, respectively. However, the standard specimens of Examples 1-4 had relatively low tensile strengths and yield strengths compared to the comparative specimens. Referring to (a) to (c) of FIG. 2, the elongation tended to decrease rapidly when the Mg content was fixed at 0.15 wt % and the Si content was sequentially increased to 6.85 wt %, 7.59 wt %, and 8.39 wt %.

Figure 3:
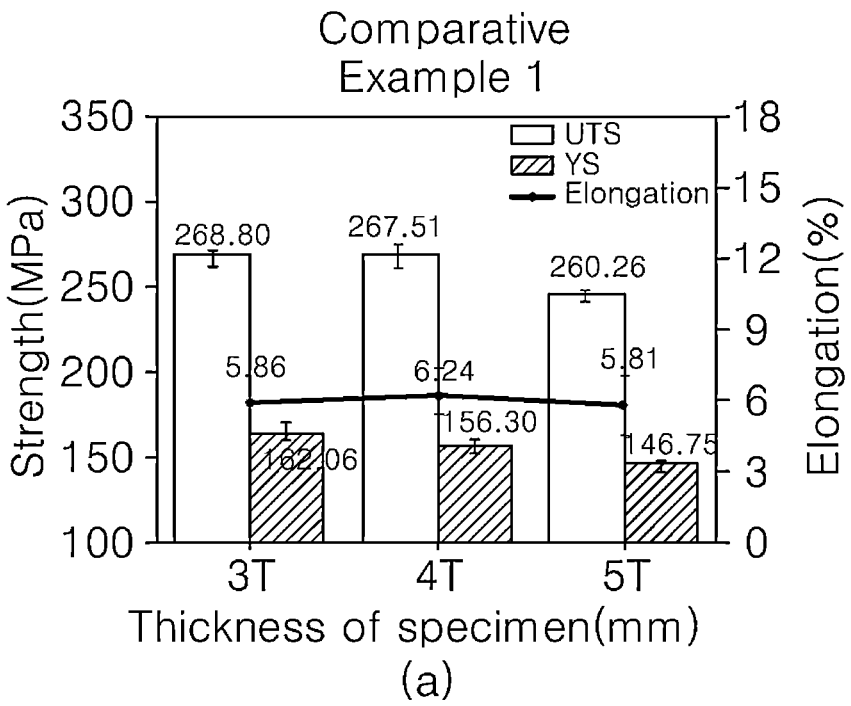
FIG. 3 shows the mechanical properties of alloy compositions prepared in Comparative Examples 1 and 2.
Figure 3:
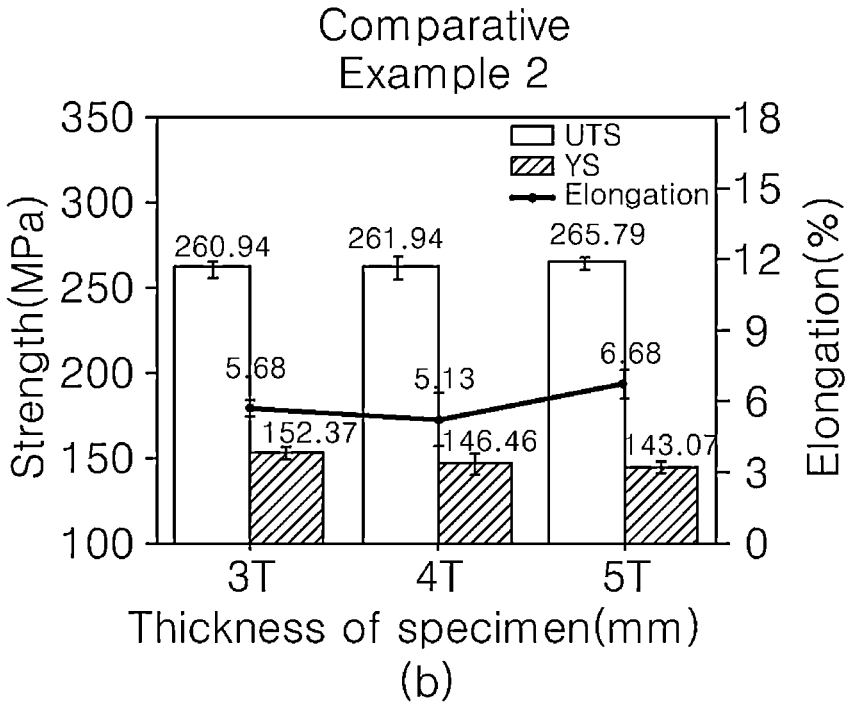

FIG. 3 shows the mechanical properties of the specimens of Comparative Examples 1-2. Referring to FIG. 3, the tensile strengths and yield strengths of the 4 mm thick standard specimens of Comparative Examples 1-2 were higher than those of the inventive specimens but the elongations of the specimens of Comparative Examples 1-2 were 6.24% and 5.13%, respectively, which were not higher than 8%. Referring to (a) of FIG. 3, the elongation was <8% when the Mg content was 0.35 wt % and the Si content was 7.78 wt %. Referring to (b) of FIG. 3, the elongation was <8% when the Mg content was 0.35 wt % and the Si content was 8.39%. In contrast, the elongation was >8% when the Mg content was 0.35 wt % and the Si content was 6.69% (see (d) of FIG. 2).

To sum up, the specimens of Example 4 and Comparative Examples 1-2, whose Mg content was 0.35 wt %, showed ~26-36% decreases in elongation compared to the specimens of Examples 1-3, whose Mg content was 0.15 wt %, demonstrating that the Mg content has a very significant influence on elongation.

Figure 4:
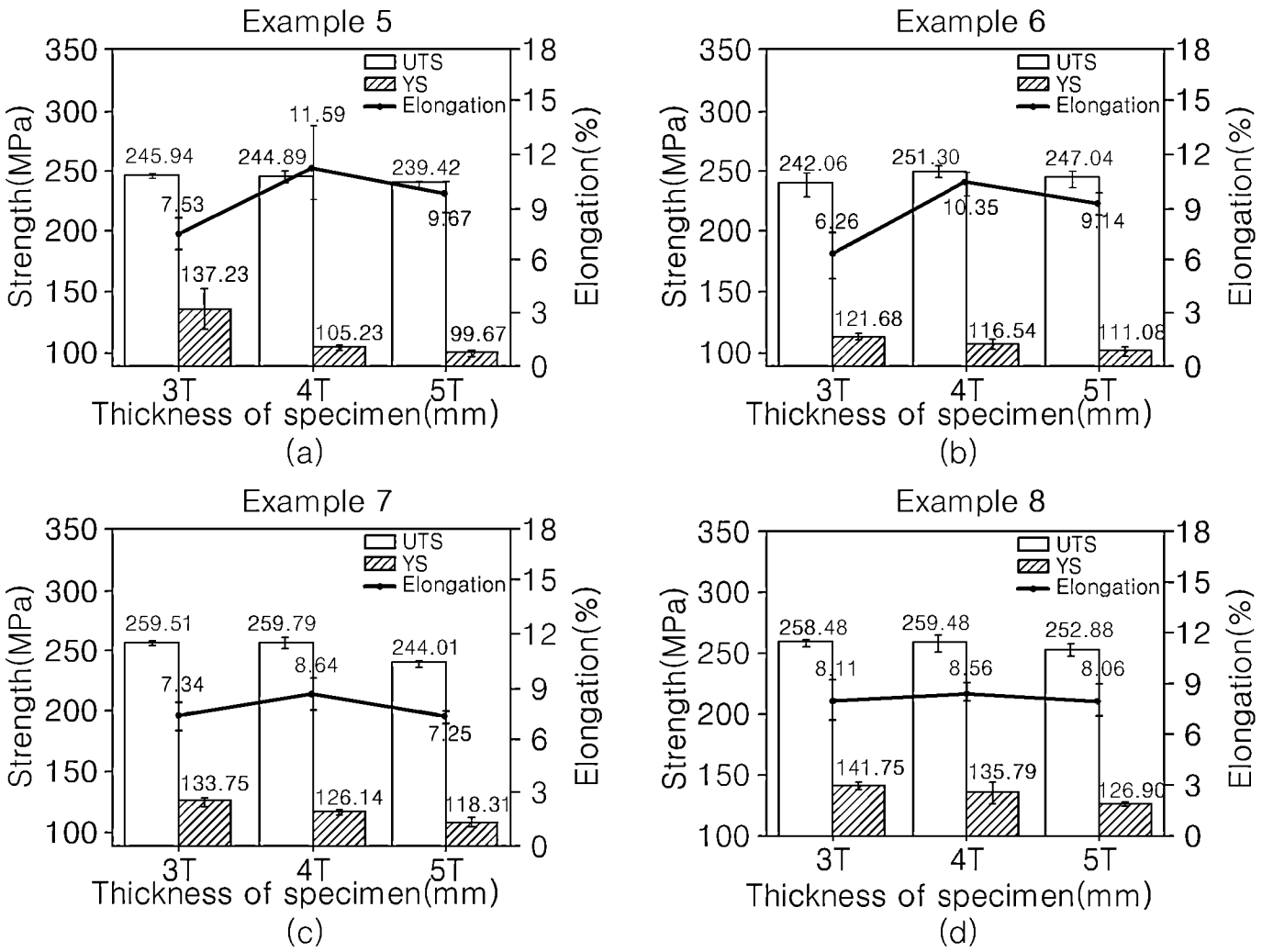
FIG. 4 shows the mechanical properties of alloy compositions prepared in Examples 5 to 8.

FIG. 4 shows the mechanical properties of the specimens of Examples 5-8. Referring to FIG. 4, the tensile strengths and yield strengths of the 4 mm thick standard specimens of Examples 5-8 were lower than those of the comparative specimens but the elongations of the specimens of Examples 5-9 were as high as 11.59%, 10.35%, 8.64%, and 8.56%, respectively. Referring to (a) to (c) of FIG. 4, the elongation tended to decrease rapidly when the Si content was fixed at 6.50 wt % and the Mg content was sequentially increased to 0.15 wt %, 0.26 wt %, and 0.38 wt %.

Figure 5:
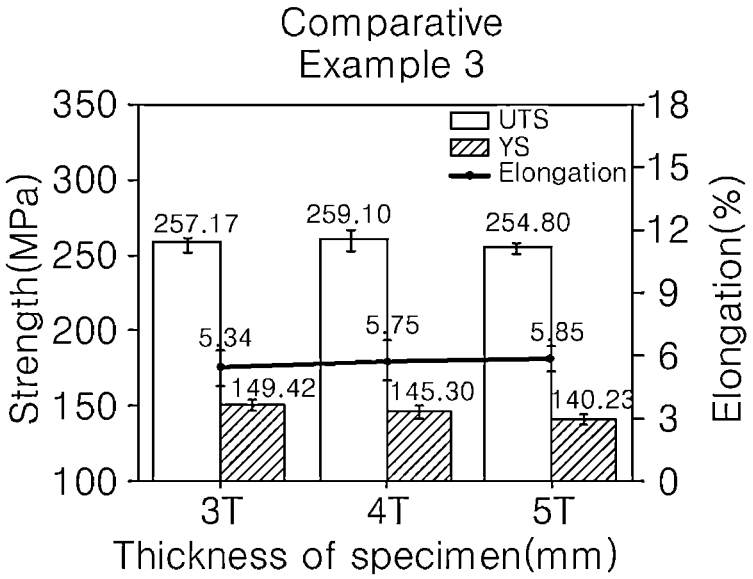
FIG. 5 shows the mechanical properties of alloy compositions prepared in Comparative Examples 3 and 4.
Figure 5:
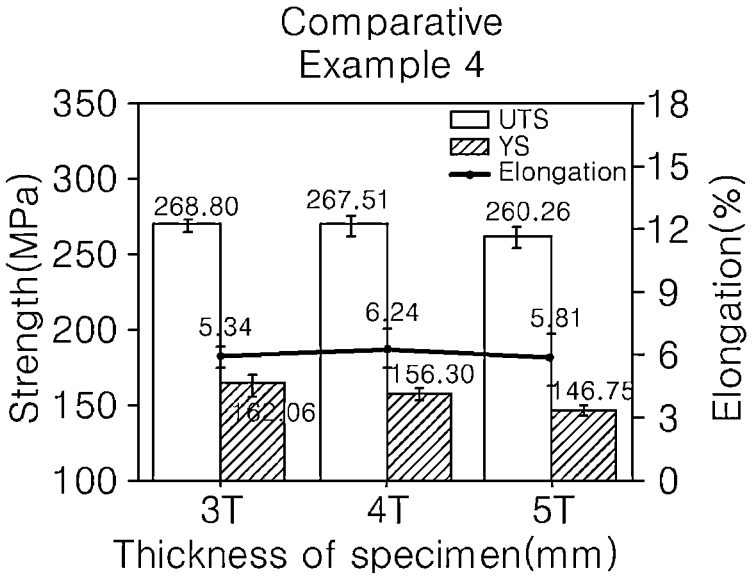

FIG. 5 shows the mechanical properties of the specimens of Comparative Examples 3-4. Referring to FIG. 5, the tensile strengths and yield strengths of the 4 mm thick standard specimens of Comparative Examples 3-4 were higher than those of the inventive specimens but the elongations of the specimens of Comparative Examples 3-4 were 5.75% and 6.24%, respectively, which were not higher than 8%. Referring to (a) of FIG. 5, the elongation was <8% when the Si content was 7.5 wt % and the Mg content was 0.29 wt %. Referring to (b) of FIG. 5, the elongation was <8% when the Si content was 7.5 wt % and the Mg content was 0.37%. In contrast, the elongation was >8% when the Si content was 7.5 wt % and the Mg content was 0.18% (see (d) of FIG. 4).

To sum up, the specimens of Example 8 and Comparative Examples 3-4, whose Si content was 7.5 wt %, showed ~26-44% decreases in elongation compared to the specimens of Examples 5-7, whose Si content was 6.5 wt %, demonstrating that the Si content also has a very significant influence on elongation.

Figure 6:
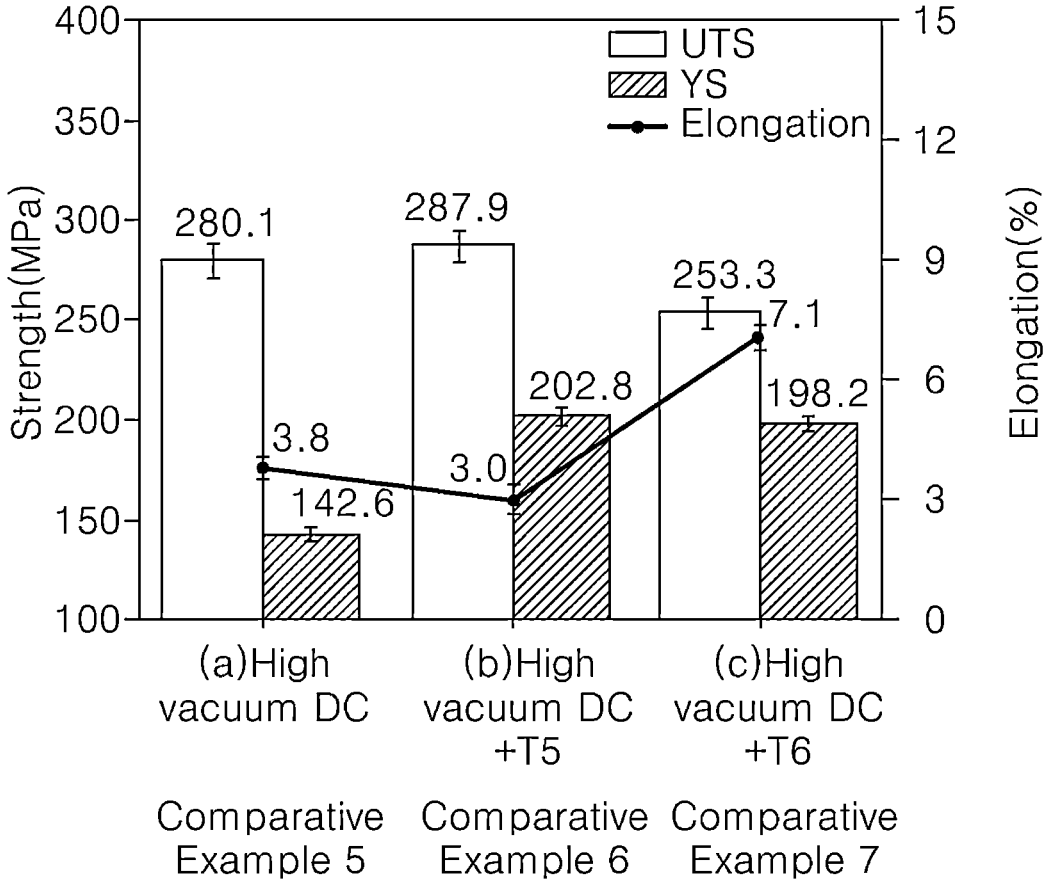
FIG. 6 shows the mechanical properties of alloy compositions prepared in Comparative Examples 5 to 7.

FIG. 6 shows the mechanical properties of the specimens of Comparative Examples 5-7. Specifically, FIG. 6 shows the mechanical properties (including tensile strengths, yield strengths, and elongations) of the Silafont-36-based compositions (a) after high vacuum die casting, (b) after high vacuum die casting and subsequent T5 treatment, and (c) after high vacuum die casting and subsequent T6 treatment. The tensile strengths and yield strengths of the 4 mm thick standard specimens of Comparative Examples 5-7 were found to be relatively high but the elongations of the specimens of Comparative Examples 5-7 were at the level of 30% of those of the inventive specimens. Therefore, the specimens of Comparative Examples 5-7 were unsuitable for automobile body parts where an elongation of at least 8.0% is required after casting (F).

The yield strength increased by ~40% from 142.6 MPa to 202.8 MPa after T5 heat treatment, while the elongation was lowered from 3.8% to 3.0% after casting. After T6 heat treatment, the yield strength increased from 142.6 MPa to 198.2 MPa and the elongation increased from 3.8% to 7.1%. However, the elongation still did not reach 8.0%, which is required in automobile body parts.

The foregoing has outlined rather broadly the features and technical advantages of the present invention so that those skilled in the art can better understand the claims that follow. It will be understood by those skilled in the art that the invention can be implemented in other specific forms without changing the spirit or essential features of the invention. Therefore, it should be noted that the forgoing embodiments are merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

What is claimed is:

1. A high elongation die casting alloy composition for non-heat treatment comprising 6.0 to 8.5% by weight of silicon (Si), 0.001 to 0.3% by weight of copper (Cu), 0.05 to 0.35% by weight of magnesium (Mg), 0.15 to 0.30% by weight of iron (Fe), 0.3 to 0.6% by weight of manganese (Mn), 0.001 to 0.3% by weight of zinc (Zn), 0.08 to 0.10% by weight of titanium (Ti), 0.01 to 0.03% by weight of strontium (Sr), and the balance aluminum (Al) wherein the silicon (Si) and magnesium (Mg) contents satisfy Relationships 1 and 2:

$$18.0<Si/Mg<56.0 \quad (1)$$

where Si/Mg represents the ratio of the silicon content to the magnesium content and is 40 or more when Si is 7.5 or more; and $$6.6<Si+Mg<8.6 \quad (2)$$

where Si+Mg represents the sum of the amounts of Si and Mg and Mg is 0.15 to 0.20 when Si is 7.5 or more.

2. A high elongation die casting alloy for non-heat treatment that is made of the composition according to claim 1, wherein the alloy is made without heat treatment after die casting.

3. The high elongation die casting alloy composition according to claim 1, further comprising more than 0% to 0.3% by weight of molybdenum (Mo) or zirconium (Zr).

4. A high elongation die casting alloy for non-heat treatment that is made of the composition according to claim 3, wherein the alloy is made without heat treatment after die casting.

5. The high elongation die casting alloy composition according to claim 1, wherein the high elongation is at least 8%.

6. A high elongation die casting alloy for non-heat treatment that is made of the composition according to claim 5, wherein the alloy is made without heat treatment after die casting.

* * * * *